US010339871B2

(12) United States Patent
Zeng et al.

(10) Patent No.: US 10,339,871 B2
(45) Date of Patent: Jul. 2, 2019

(54) SCAN DRIVING CURCUIT AND DISPLAY PANEL

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Limei Zeng, Guangdong (CN); Shu-Jhih Chen, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/744,791

(22) PCT Filed: Dec. 20, 2017

(86) PCT No.: PCT/CN2017/117351
§ 371 (c)(1),
(2) Date: Jan. 13, 2018

(65) Prior Publication Data

US 2019/0139494 A1 May 9, 2019

(30) Foreign Application Priority Data

Nov. 7, 2017 (CN) ..... 2017 1 1088140

(51) Int. Cl.
*G09G 3/3266* (2016.01)

(52) U.S. Cl.
CPC ... *G09G 3/3266* (2013.01); *G09G 2310/0267* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 2006/0227094 | A1 | 10/2006 | Park et al. | |
| 2012/0140871 | A1 | 6/2012 | Yang et al. | |
| 2017/0186387 | A1 | 6/2017 | Wang et al. | |
| 2017/0193887 | A1 | 7/2017 | Wang et al. | |
| 2017/0278450 | A1* | 9/2017 | Ma | G09G 3/2092 |
| 2018/0108300 | A1* | 4/2018 | Zhao | G09G 3/3674 |

FOREIGN PATENT DOCUMENTS

| | | |
|---|---|---|
| CN | 107180618 A | 9/2017 |
| CN | 207097429 U | 3/2018 |

* cited by examiner

*Primary Examiner* — Kenneth B Lee, Jr.
(74) *Attorney, Agent, or Firm* — Hauptman Ham, LLP

(57) ABSTRACT

A scan driving circuit and a display panel are disclosed. A scan driving unit includes a pull-up control circuit configured for receiving a stage transmission signal of the previous two stages to charge a pull-up control signal node. A first reset circuit receives an input signal, a first clock signal and a second clock signal to reset the pull-up control signal node, wherein the input signal is a DC voltage. A pull-down holding circuit receives a low frequency clock signal and a second low frequency clock signal to hold the electric potential of the pull-up control signal node. A pull-down circuit receives a scan driving signal of the next two stages to pull down the electric potential of the pull-up control signal node. A pull-up circuit receives the first clock signal to output a stage transmission signal and a scan driving signal of the current stage.

14 Claims, 3 Drawing Sheets

SCAN DRIVING CURCUIT AND DISPLAY PANEL

RELATED APPLICATIONS

The present application is a National Phase of International Application Number PCT/CN2017/117351, filed Dec. 20, 2017, and claims the priority of China Application No. 201711088140.9, filed Nov. 7, 2017.

FIELD OF THE DISCLOSURE

The disclosure relates to a display technology, and more particularly to a scan driving circuit and a display panel.

BACKGROUND

The GOA (Gate Driver On Array or Gate On Array) circuit is a technology using the existing TFT-LCD array process to manufacture the gate scan driving signal circuit on the array substrate to achieve the driving method to progressively scan the gate line. Compared with the transitional COF and COG process, it not only saves the cost but also reduce the gate direction bonding process. It is extremely beneficial to improve productivity and increase the integrity of the display device. As the technology of low temperature poly-silicon (LTPS) in thin-film transistor (TFT) advances and the characteristic of ultra-high carrier mobility of the LTPS semiconductor, the corresponding peripheral integrated circuit of the panel has drawn much attention. However, shown as FIG. 1, the scan driving circuit of the conventional display panel resets a pull-up control signal node Q(N) by a reset signal Reset or a trigger signal STV received a reset thin film transistor Tr. When the circuit is operated, the highest electric potential of the pull-up control signal node Q(N) reaches twice of the voltage VGH, and the voltage received by the gate, drain, and source of the reset thin film transistor Tr is higher (illustrated as FIG. 2). So, the reset thin film transistor Tr easily occurs current leakage, and more worse under a long operating time, so as to lead the reliability of the circuit poor.

SUMMARY

The technical problem the present disclosure is to provide a scan driving circuit and a display panel, which are capable of preventing current leakage of the thin film transistor.

To solve the above technical problem, the disclosure provides a scan driving circuit having a plurality of cascaded scan driving units, wherein each scan driving unit includes:

a pull-up control circuit, configured for receiving a stage transmission signal of the previous two stages to charge a pull-up control signal node;

a first reset circuit, coupled to the pull-up control circuit, configured for receiving an input signal, a first clock signal and a second clock signal to reset the pull-up control signal node, wherein the input signal is a DC voltage;

a pull-down holding circuit, coupled to the pull-up control circuit, configured for receiving a low frequency clock signal and a second low frequency clock signal to hold the electric potential of the pull-up control signal node;

a pull-down circuit, coupled to the pull-up control circuit, configured for receiving a scan driving signal of the next two stages to pull down the electric potential of the pull-up control signal node; and a pull-up circuit, coupled to the pull-up control circuit, the pull-down holding circuit and the pull-down circuit, configured for receiving the first clock signal to output a stage transmission signal and a scan driving signal of the current stage.

Also, the disclosure provides a display panel having a scan driving circuit, the scan driving circuit having a plurality of cascaded scan driving units, each scan driving unit includes:

a pull-up control circuit, configured for receiving a stage transmission signal of the previous two stages to charge a pull-up control signal node;

a first reset circuit, coupled to the pull-up control circuit, configured for receiving an input signal, a first clock signal and a second clock signal to reset the pull-up control signal node, wherein the input signal is a DC voltage;

a pull-down holding circuit, coupled to the pull-up control circuit, configured for receiving a low frequency clock signal and a second low frequency clock signal to hold the electric potential of the pull-up control signal node;

a pull-down circuit, coupled to the pull-up control circuit, configured for receiving a scan driving signal of the next two stages to pull down the electric potential of the pull-up control signal node; and a pull-up circuit, coupled to the pull-up control circuit, the pull-down holding circuit and the pull-down circuit, configured for receiving the first clock signal to output a stage transmission signal and a scan driving signal of the current stage.

Distinguished with current technology, the disclosure can avoid the leakage current caused by the voltage of the pull-up control signal node is too large since the reset circuit receives the trigger signal or the reset signal, so as to increase the increase reliability of the circuit.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
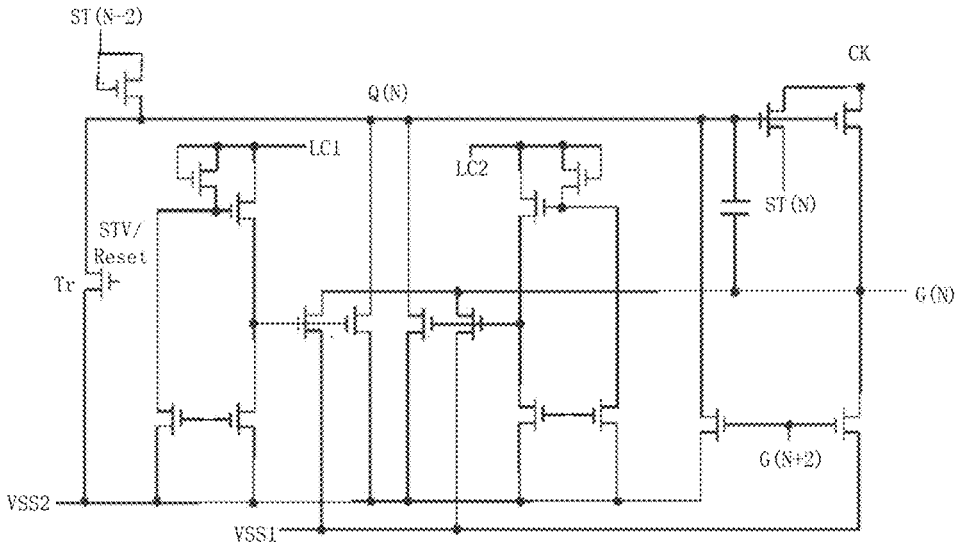
FIG. 1 is a structural schematic diagram of a conventional scan driving circuit.
Figure 2:
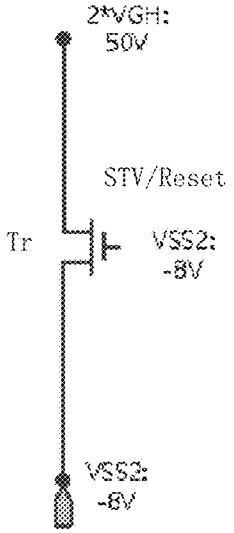
FIG. 2 is a schematic diagram of the voltage received by a thin film transistor of the scan driving circuit in FIG. 1.
Figure 3:
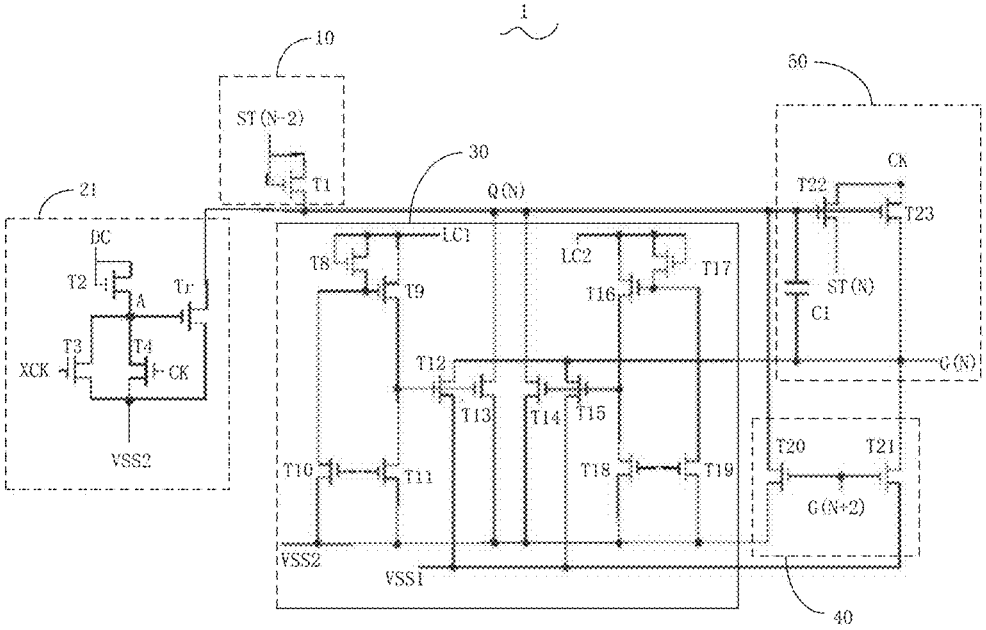
FIG. 3 is a circuit schematic diagram of a scan driving circuit according to a first embodiment of the disclosure.

Reference is made to FIG. 3, which is a circuit schematic diagram of a scan driving circuit according to a first embodiment of the disclosure. The scan driving circuit having a plurality of cascaded scan driving units 1 (illustrated by Nth scan driving unit hereinafter). The scan driving unit 1 includes a pull-up control circuit 10, a first reset circuit 21, a pull-down holding circuit 30, a pull-down circuit 40 and a pull-up circuit 50.

The pull-up control circuit 10 is configured for receiving a stage transmission signal of the previous two stages ST(N−2) to charge a pull-up control signal node Q(N).

The first reset circuit 21 is coupled to the pull-up control circuit 10, configured for receiving an input signal, a first clock signal CK and a second clock signal XCK to reset the pull-up control signal node Q(N), wherein the input signal is a DC voltage.

A pull-down holding circuit 30 is coupled to the pull-up control circuit 10, configured for receiving a low frequency clock signal LC1 and a second low frequency clock signal LC2 to hold the electric potential of the pull-up control signal node Q(N).

A pull-down circuit 40 is coupled to the pull-up control circuit 10, configured for receiving a scan driving signal of the next two stages G(N+2) to pull down the electric potential of the pull-up control signal node Q(N).

A pull-up circuit 50 is coupled to the pull-up control circuit 10, the pull-down holding circuit 40 and the pull-down circuit 30, configured for receiving the first clock signal CK1 to output a stage transmission signal of the current stage ST(N) and a scan driving signal of the current stage G(N).

Specifically, the pull-up control circuit 10 includes a first controllable switch T1. A control end of the first controllable switch T1 coupled to a first end of the first controllable switch T1 receives the stage transmission signal of the previous stage ST(N−2). A second end of the first controllable switch T1 couples to the first reset circuit 21.

Specifically, the first reset circuit 21 includes a second controllable switch T2, a third controllable switch T3, a fourth controllable switch T4 and a first reset switch Tr1. A control end of the second controllable switch T2 coupled to a first end of the second controllable switch T2 receives the input signal. A control end of the first reset switch T1, a first end of the third controllable switch T3 and a first end of the fourth controllable switch T4 are coupled to a second end of the second controllable switch T2. A control end of the third controllable switch T3 receives the second clock signal XCK and a control end of the fourth controllable switch T4 receives the first clock signal CK. The second end of the first controllable switch T1 is coupled to a first end of the first reset switch Tr1. Second ends of the third controllable switch T3, the fourth controllable switch T4 and the first reset switch Tr1 are coupled to a first voltage terminal VSS2.

Specifically, the pull-down holding circuit 30 includes an eighth controllable switch T8, a ninth controllable switch T9 . . . and a nineteenth controllable switch T19. A first control end of the eighth controllable switch T8 coupled to a first end of the eighth controllable switch T8 and a first end of the ninth controllable switch T9 receives the first low frequency clock signal LC1. A control end of the ninth controllable switch T9 and a first end of the tenth controllable switch T10 are coupled to a second end of the eighth controllable switch T8. A first end of the eleventh controllable switch T11, a control end of the twelfth controllable switch T12 and a control end of the thirteenth controllable switch T13 are coupled to a second end of the ninth controllable switch T9. A control end of the eleventh controllable switch T11 and the pull-up control signal node Q(N) are coupled to a control end of the tenth controllable switch T10. A first end of the fifteenth controllable switch T15 and the pull-up circuit 50 are coupled to a first end of the twelfth controllable switch T12. A second end of the first controllable switch T1 and the pull-up control signal node Q(N) are coupled to a first end of the thirteenth controllable switch T13. A control end of the fifteenth controllable switch T15, a second end of the sixteenth controllable switch T6 and a first end of the eighteenth controllable switch T18 are coupled to a control end of the fourteenth controllable switch T14. A first end of the fourteenth controllable switch T14 is coupled to the pull-up control signal node Q(N). A second end of the seventeenth controllable switch T17 and a first end of the nineteenth controllable switch T19 are coupled to a control end of the sixteenth controllable switch T16. A first end of the sixteenth controllable switch T16 coupled to a first end of the seventeenth controllable switch T17 and a control end of the seventeenth controllable switch T17 receives the second low frequency clock signal LC2. A control end of the nineteenth controllable switch T19 and the pull-up control signal node Q(N) are coupled to a control end of the eighteenth controllable switch T18. A second end of the tenth controllable switch T10, a second end of the eleventh controllable switch T11, a second end of the thirteenth controllable switch T13, a second end of the fourteenth controllable switch T14, a second end of the eighteenth controllable switch T18 and a second end of the nineteenth controllable switch T19 are coupled to the first voltage terminal VSS2. A second end of the twelfth controllable switch T12 and a second of the fifteenth controllable switch T15 are coupled to the second voltage terminal VSS1.

Specifically, the pull-down circuit 40 includes a twentieth controllable switch T20 and a twenty-first controllable switch T21. A control end of the twentieth controllable switch T20 coupled to a control end of the twenty-first controllable switch T21 receives the scan driving signal of the next stage G(N+2). The pull-up control signal node Q(N) and the pull-up circuit 50 are coupled to a first end of the twentieth controllable switch T20. A second end of the twentieth controllable switch T20 is coupled to the first voltage terminal VSS2. A first end of the twenty-first controllable switch T21 is coupled to the pull-up circuit 50. A second end of the twenty-first controllable switch T21 is coupled to the second voltage terminal VSS1.

Specifically, the pull-up circuit 50 includes a twenty-second controllable switch T22, a twenty-third controllable switch T23 and a capacitor C1. A control end of the twenty-third controllable switch T23 and a first end of the twelfth controllable switch T20 are coupled to a control end of the twenty-second controllable switch T22. A first end of the twenty-second controllable switch T22 coupled to a first end of the twenty-third controllable switch T23 receives the first clock signal CK. A second end of the twenty-second controllable switch T22 outputs the stage transmission signal of the current stage ST(N). A scan line and the first end of the twenty-first controllable switch T21 and the first end of the fifteenth controllable switch T15 are coupled to a second end of the twenty-third controllable switch T23. The scan line is configured to output the scan driving signal of the current stage G(N). A first end of the capacitor C1 is coupled to the control end of the twenty-second controllable switch T22. A second end of the capacitor C1 is coupled to the scan line.

The phase of the first clock signal CK is opposite to the phase of the second clock signal XCK. The phase of the first low frequency signal LC1 is opposite to the phase of the second low frequency signal LC2. The periods of the first low frequency signal LC1 and the second low frequency signal LC2 are greater than the periods of the first clock signal CK and the second clock signal XCK. The voltages of the first voltage terminal VSS2 and the second voltage terminal VSS1 are the negative voltage. The voltage of the first voltage terminal VSS2 is less than the second voltage terminal VSS1. The stage transmission signal of the previous stage ST(N−2) is the stage transmission signal of the previous two stages. The scan driving signal of the next stage G(N+2) is the scan driving signal of the next two stages.

In this embodiment, the first controllable switch T1, the second controllable switch T2 . . . , and the fourth controllable switch T4, the eighth controllable switch T8, the ninth controllable switch T9 . . . , and the twenty-third controllable switch T23, and the first reset switch Tr1 are the N-type thin film transistors. The control ends, the first ends and the seconds of the second controllable switch T2 . . . , and the fourth controllable switch T4, the eighth controllable switch T8, the ninth controllable switch T9 . . . , and the twenty-third controllable switch T23, and the first reset switch Tr1 are respectively corresponded to the gates, the drains, and the sources of the thin film transistors.

The working principle of the scan driving circuit is described as follow (this embodiment is illustrated by Nth scan driving unit hereinafter):

In response to the control end of the second controllable switch T2 receives the DC voltage, the second controllable switch T2 is turned on. At this moment, the electric potential of the A point is high. During the data transmission of each frame, in response to one of the first clock signal CK and the second clock signal XCK is high electric potential, one of the third controllable switch T3 and the fourth controllable switch T4 is turned on and the high electric potential of the A point is pulled down by the first voltage terminal VSS2. At this moment, the first reset switch Tr1 is turned off, and the first reset circuit 21 doesn't reset the scan driving unit 1. During a blank time between data transmission of two frames (i.e., a gap between the data transmission of two frames), in response to both of the first clock signal CK and the second clock signal XCK are low electric potential, both of the third controllable switch T3 and the fourth controllable switch T4 are turned off. Thus, the electric potential of the A point maintains the high electric potential. At this moment, in response to the first reset switch Tr1 is turned on, the electric potential of the pull-up control signal node Q(N) is pulled down by the first voltage terminal VSS2. The first reset circuit 21 resets the scan driving unit 1 to avoid the leakage current caused by the voltage of the pull-up control signal node is too large since the reset circuit receives the trigger signal or the reset signal, so as to increase the increase reliability of the circuit. Working principle of other circuit part of the scan driving unit is similar to the conventional scan driving unit, it is omitted herein. As the same, working principle of other scan driving units is similar to Nth scan driving unit, it is also omitted herein.

Figure 4:
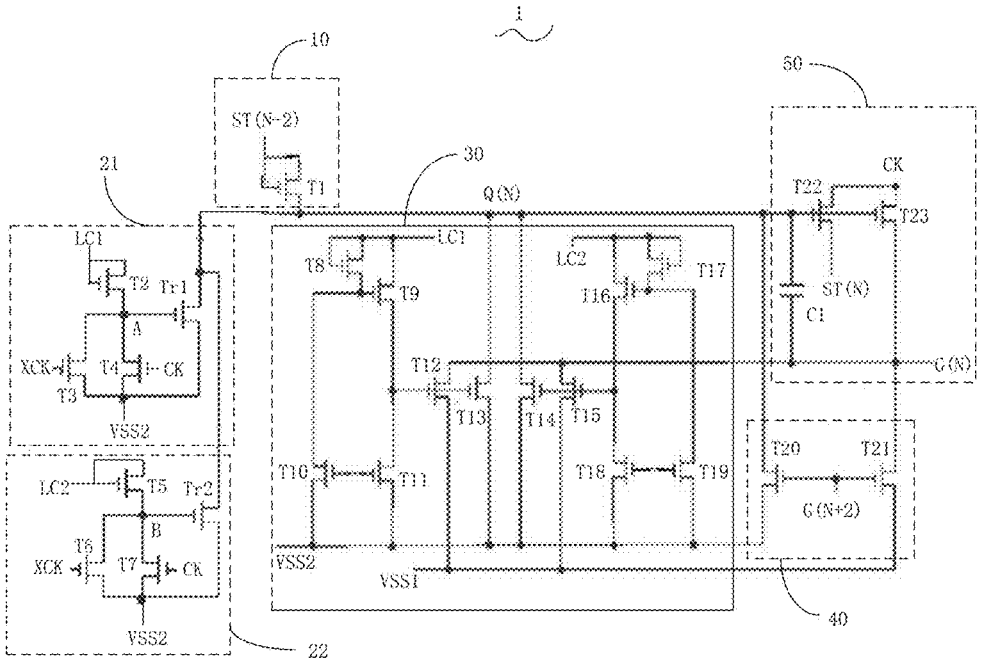
FIG. 4 is a circuit schematic diagram of a scan driving circuit according to a second embodiment of the disclosure.

Reference is made to FIG. 4, which is a circuit schematic diagram of a scan driving circuit according to a second embodiment of the disclosure. The difference between the second embodiment and the first embodiment said above is:

If the input signal of the first reset circuit 21 is the first low frequency clock signal LC1, the scan driving circuit further includes a second reset circuit 22. The second reset circuit 22 is coupled to the pull-up control circuit 10 and the first reset circuit 21, and is configured for receiving the second low frequency clock signal LC2, the first clock signal CK and the second clock signal XCK to reset the pull-up control signal node Q(N). The first reset circuit 21 and the second reset circuit 22 are alternately derived.

Specifically, the second reset circuit 22 includes a fifth controllable switch T5, a sixth controllable switch T6, a seventh controllable switch T7 and a second reset switch Tr2. A control end of the fifth controllable switch T5 coupled to a first end of the fifth controllable switch T5 receives the second low frequency clock signal LC2. A control end of the second reset switch Tr2, the first end of the sixth controllable switch T6 and a first end of the seventh controllable switch T7 are coupled to a second end of the fifth controllable switch T5. A control end of the sixth controllable switch T6 receives the second clock signal XCK. A control end of the seventh controllable switch T7 receives the first clock signal CK. A second end of the second reset switch Tr2 is coupled to the second end of the first controllable switch T1. The second ends of the sixth controllable switch T6, the seventh controllable switch T7 and the second reset switch Tr2 are coupled to the first voltage terminal VSS2.

In this embodiment, the first controllable switch T1, the second controllable switch T2 . . . the twenty-third controllable switch T23, the first reset switch Tr1 and the second reset switch Tr2 are the N-type thin film transistors. The control ends, the first ends and the seconds of the first controllable switch T1, the second controllable switch T2 . . . the twenty-third controllable switch T23, the first reset switch Tr1 and the second reset switch Tr2 are respectively corresponded to the gates, the drains, and the sources of the thin film transistors.

Figure 5:
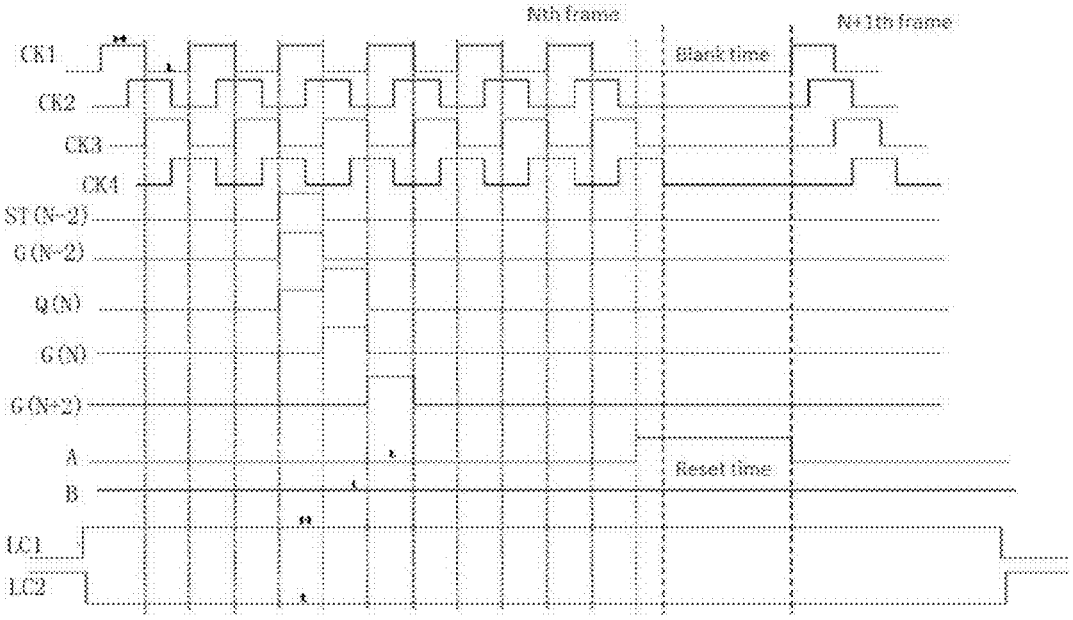
FIG. 5 is a schematic oscillogram of the scan driving circuit according to the embodiment of the disclosure.

Reference is made to FIG. 4 and FIG. 5. The working principle of the scan driving circuit is described as follow (this embodiment is illustrated by Nth scan driving unit hereinafter):

In response to the input voltage of the control end of the second controllable switch T2 is the first low frequency clock signal LC1 and the electric potential of the first low frequency clock signal LC1 is high, the second controllable switch T2 is turned on. At this moment, the electric potential of the A point is high. During the data transmission of each frame, in response to one of the first clock signal CK and the second clock signal XCK is high electric potential, one of the third controllable switch T3 and the fourth controllable switch T4 is turned on, and the high electric potential of the A point is pulled down by the first voltage terminal VSS2. At this moment, the first reset switch Tr1 is turned off, and the first reset circuit 21 doesn't reset the scan driving unit 1. At this moment, in response to the electric potential of the second low frequency clock signal LC2 is low, the fifth controllable switch T5 is turned off. At this moment, the electric potential of the B point is low, the second reset switch Tr2 is turned off, and the second reset circuit 22 doesn't reset the scan driving unit 1. During a blank time between data transmission of two frames (i.e., a gap between the data transmission of two frames), in response to both of the first clock signal CK and the second clock signal XCK are low electric potential, both of the third controllable switch T3 and the fourth controllable switch T4 are turned off. Thus, the electric potential of the A point maintains the high electric potential. At this moment, in response to the first reset switch Tr1 is turned on, the electric potential of the pull-up control signal node Q(N) is pulled down by the first voltage terminal VSS2. The first reset circuit 21 resets the scan driving unit 1.

In response to the electric potential of the first low frequency clock signal LC1 is low and the electric potential of the second low frequency clock signal LC2 is high, the fifth controllable switch T5 is turned on. At this moment, the electric potential of the point B is high. During the data transmission of each frame, in response to one of the first clock signal CK and the second clock signal XCK is high electric potential, one of the sixth controllable switch T6 and the seventh controllable switch T7 is turned on, and the high electric potential of the B point is pulled down by the first voltage terminal VSS2. At this moment, the second reset switch Tr2 is turned off, and the first reset circuit 22 doesn't reset the scan driving unit 1. At this moment, in response to the electric potential of the first low frequency clock signal LC1 is low, the second controllable switch T2 is turned off. At this moment, the electric potential of the A point is low, the first reset switch Tr1 is turned off, and the first reset circuit 21 doesn't reset the scan driving unit 1. During a blank time between data transmission of two frames (i.e., a gap between the data transmission of two frames), in response to both of the first clock signal CK and the second clock signal XCK are low electric potential, both of the sixth controllable switch T6 and the seventh controllable switch T7 are turned off. Thus, the electric potential of the A point maintains the high electric potential. At this moment, in response to the second reset switch Tr2 is turned on, the electric potential of the pull-up control signal node Q(N) is pulled down by the first voltage terminal VSS2. The second reset circuit 22 resets the scan driving unit 1. This embodiment achieves that the first reset circuit 21 and the second reset circuit 22 are alternately derived according to the first low frequency clock signal LC1 or the second low frequency clock signal LC2. It can avoid the leakage current caused by the voltage of the pull-up control signal node is too large since the reset circuit receives the trigger signal or the reset signal and more worse under a long operating time, so as to increase the increase reliability of the circuit. Working principle of other circuit part of the scan driving unit is similar to the conventional scan driving unit, it is omitted herein. As the same, working principle of other scan driving units is similar to Nth scan driving unit, it is also omitted herein.

Figure 6:
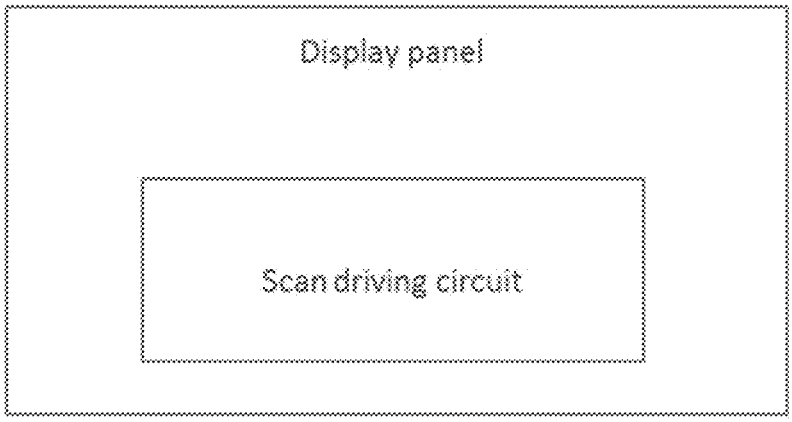
FIG. 6 is a structural schematic diagram of a display panel according to an embodiment of the disclosure.

Reference is made to FIG. 6, which is a structural schematic diagram of a display panel according to an embodiment of the disclosure. The display panel includes least one of the scan driving circuit said above. The display panel is made by OLED or LCD. Other elements or functions regarding the display panel of this disclosure are similar to the conventional display panel, so it is omitted herein.

Since the first reset circuit and the second reset circuit receive the DC voltage or are reset by alternately deriving according to the first low frequency clock signal and the second low frequency clock signal, the scan driving circuit and the display panel can avoid the leakage current caused by the voltage of the pull-up control signal node is too large since the reset circuit receives the trigger signal or the reset signal, and more worse under a long operating time, so as to increase the increase reliability of the circuit.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A scan driving circuit having a plurality of cascaded scan driving units, wherein each scan driving unit comprises:

a pull-up control circuit comprising a first controllable switch, configured for receiving a stage transmission signal of the previous two stages to charge a pull-up control signal node;

a first reset circuit, coupled to the pull-up control circuit, configured for receiving an input signal, a first clock signal and a second clock signal to reset the pull-up control signal node, wherein the input signal is a DC voltage;

a pull-down holding circuit, coupled to the pull-up control circuit, configured for receiving a low frequency clock signal and a second low frequency clock signal to hold the electric potential of the pull-up control signal node;

a pull-down circuit, coupled to the pull-up control circuit, configured for receiving a scan driving signal of the next two stages to pull down the electric potential of the pull-up control signal node; and a pull-up circuit, coupled to the pull-up control circuit, the pull-down holding circuit and the pull-down circuit, configured for receiving the first clock signal to output a stage transmission signal and a scan driving signal of the current stage;

wherein if the input signal of the first reset circuit is the first low frequency clock signal, the scan driving circuit further comprises:

a second reset circuit, coupled to the pull-up control circuit and the first reset circuit, configure for receiving the second low frequency clock signal, the first clock signal and the second clock signal to reset the pull-up control signal node, wherein the first reset circuit and the second reset circuit are alternately derived according to the first low frequency clock signal or the second low frequency clock signal;

wherein the first reset circuit comprises a second controllable switch, a third controllable switch, a fourth controllable switch and a first reset switch; a control end of the second controllable switch coupled to a first end of the second controllable switch receives the input signal; a control end of the first reset switch, a first end of the third controllable switch and a first end of the fourth controllable switch are coupled to a second end of the second controllable switch; a control end of the third controllable switch receives the second clock signal and a control end of the fourth controllable switch receives the first clock signal; the second end of the first controllable switch and the second reset circuit are coupled to a first end of the first reset switch; second ends of the third controllable switch, the fourth controllable switch and the first reset switch are coupled to a first voltage terminal;

the second reset circuit comprises a fifth controllable switch, a sixth controllable switch, a seventh controllable switch and a second reset switch; a control end of the fifth controllable switch coupled to a first end of the fifth controllable switch receives the second low frequency clock signal; a control end of the second reset switch, the first end of the sixth controllable switch and a first end of the seventh controllable switch are coupled to a second end of the fifth controllable switch; a control end of the sixth controllable switch receives the second clock signal; a control end of the seventh controllable switch receives the first clock signal; a second end of the second reset switch is coupled to the second end of the first controllable switch; second ends of the sixth controllable switch, the seventh controllable switch and the second reset switch are coupled to the first voltage terminal.

2. The scan driving circuit according to claim 1, wherein a control end of the first controllable switch coupled to a first end of the first controllable switch receives the stage transmission signal of the previous two stages, a second end of the first controllable switch couples to the first reset circuit and the second reset circuit.

3. The scan driving circuit according to claim 2, wherein the pull-down holding circuit comprises an eighth controllable switch, a ninth controllable switch . . . and a nineteenth controllable switch; a control end of the eighth controllable switch coupled to a first end of the eighth controllable switch and a first end of the ninth controllable switch receives the first low frequency clock signal; a control end of the ninth controllable switch and a first end of the tenth controllable switch are coupled to a second end of the eighth controllable switch; a first end of the eleventh controllable switch, a control end of the twelfth controllable switch and a control end of the thirteenth controllable switch are coupled to a second end of the ninth controllable switch; a control end of the eleventh controllable switch and the pull-up control signal node are coupled to a control end of the tenth controllable switch; a first end of the fifteenth controllable switch and the pull-up circuit are coupled to a first end of the twelfth controllable switch; a second end of the first controllable switch and the pull-up control signal node are coupled to a first end of the thirteenth controllable switch; a control end of the fifteenth controllable switch, a second end of the sixteenth controllable switch and a first end of the eighteenth controllable switch are coupled to a control end of the fourteenth controllable switch; a first end of the fourteenth controllable switch is coupled to the pull-up control signal node; a second end of the seventeenth controllable switch and a first end of the nineteenth controllable switch are coupled to a control end of the sixteenth controllable switch; a first end of the sixteenth controllable switch coupled to a first end of the seventeenth controllable switch and a control end of the seventeenth controllable switch receives the second low frequency clock signal; a control end of the nineteenth controllable switch and the pull-up control signal node are coupled to a control end of the eighteenth controllable switch; a second end of the tenth controllable switch, a second end of the eleventh controllable switch, a second end of the thirteenth controllable switch, a second end of the fourteenth controllable switch, a second end of the eighteenth controllable switch and a second end of the nineteenth controllable switch are coupled to the second voltage terminal; a second end of the twelfth controllable switch and a second of the fifteenth controllable switch are coupled to the second voltage terminal.

4. The scan driving circuit according to claim 3, wherein the pull-down circuit comprises a twentieth controllable switch and a twenty-first controllable switch; a control end of the twentieth controllable switch coupled to a control end of the twenty-first controllable switch receives the scan driving signal of the next two stages; the pull-up control signal node and the pull-up circuit are coupled to a first end of the twentieth controllable switch; a second end of the twentieth controllable switch is coupled to the first voltage terminal; a first end of the twenty-first controllable switch is coupled to the pull-up circuit; a second end of the twenty-first controllable switch is coupled to the second voltage terminal.

5. The scan driving circuit according to claim 4, wherein the pull-up circuit comprises a twenty-second controllable switch, a twenty-third controllable switch and a capacitor; a control end of the twenty-third controllable switch and a first end of the twelfth controllable switch are coupled to a control end of the twenty-second controllable switch; a first end of the twenty-second controllable switch coupled to a first end of the twenty-third controllable switch receives the first clock signal; a second end of the twenty-second controllable switch outputs the stage transmission signal of the current stage; a scan line and the first end of the twenty-first controllable switch and the first end of the fifteenth controllable switch are coupled to a second end of the twenty-third controllable switch; the scan line is configured to output the scan driving signal of the current stage; a first end of the capacitor is coupled to the control end of the twenty-second controllable switch; a second end of the capacitor is coupled to the scan line.

6. The scan driving circuit according to claim 3, wherein the phase of the first clock signal is opposite to the phase of the second clock signal, and the phase of the first low frequency signal is opposite to the phase of the second low frequency signal; the periods of the first low frequency signal and the second low frequency signal are greater than the periods of the first clock signal and the second clock signal; the voltages of the first voltage terminal and the second voltage terminal are the negative voltage, and the voltage of the first voltage terminal is less than the second voltage terminal; the stage transmission signal of the previous stage is the stage transmission signal of the previous two stages, and the scan driving signal of the next stage is the scan driving signal of the next two stages.

7. The scan driving circuit according to claim 5, wherein the first controllable switch, the second controllable switch . . . the twenty-third controllable switch, the first reset switch and the second reset switch are the N-type thin film transistors; the control ends, the first ends and the second ends of the first controllable switch, the second controllable switch . . . the twenty-third controllable switch, the first reset switch and the second reset switch are respectively corresponded to the gates, the drains, and the sources of the thin film transistors.

8. A display panel, having a scan driving circuit, the scan driving circuit having a plurality of cascaded scan driving units, each scan driving unit comprises:

a pull-up control circuit comprising a first controllable switch, configured for receiving a stage transmission signal of the previous two stages to charge a pull-up control signal node;

a first reset circuit, coupled to the pull-up control circuit, configured for receiving an input signal, a first clock signal and a second clock signal to reset the pull-up control signal node, wherein the input signal is a DC voltage;

a pull-down holding circuit, coupled to the pull-up control circuit, configured for receiving a low frequency clock signal and a second low frequency clock signal to hold the electric potential of the pull-up control signal node;

a pull-down circuit, coupled to the pull-up control circuit, configured for receiving a scan driving signal of the next two stages to pull down the electric potential of the pull-up control signal node; and a pull-up circuit, coupled to the pull-up control circuit, the pull-down holding circuit and the pull-down circuit, configured for receiving the first clock signal to output a stage transmission signal and a scan driving signal of the current stage;

wherein if the input signal of the first reset circuit is the first low frequency clock signal, the scan driving circuit further comprises:

a second reset circuit, coupled to the pull-up control circuit and the first reset circuit, configure for receiving the second low frequency clock signal, the first clock signal and the second clock signal to reset the pull-up control signal node, wherein the first reset circuit and the second reset circuit are alternately derived according to the first low frequency clock signal or the second low frequency clock signal;

wherein the first reset circuit comprises a second controllable switch, a third controllable switch, a fourth controllable switch and a first reset switch; a control end of the second controllable switch coupled to a first end of the second controllable switch receives the input signal; a control end of the first reset switch, a first end of the third controllable switch and a first end of the fourth controllable switch are coupled to a second end of the second controllable switch; a control end of the third controllable switch receives the second clock signal and a control end of the fourth controllable switch receives the first clock signal; the second end of the first controllable switch and the second reset circuit are coupled to a first end of the first reset switch; second ends of the third controllable switch, the fourth controllable switch and the first reset switch are coupled to a first voltage terminal;

the second reset circuit comprises a fifth controllable switch, a sixth controllable switch, a seventh controllable switch and a second reset switch; a control end of the fifth controllable switch coupled to a first end of the fifth controllable switch receives the second low frequency clock signal; a control end of the second reset switch, the first end of the sixth controllable switch and a first end of the seventh controllable switch are coupled to a second end of the fifth controllable switch; a control end of the sixth controllable switch receives the second clock signal; a control end of the seventh controllable switch receives the first clock signal; a second end of the second reset switch is coupled to the second end of the first controllable switch; second ends of the sixth controllable switch, the seventh controllable switch and the second reset switch are coupled to the first voltage terminal.

9. The display panel according to claim 8, wherein a control end of the first controllable switch coupled to a first end of the first controllable switch receives the stage transmission signal of the previous two stages, a second end of the first controllable switch couples to the first reset circuit and the second reset circuit.

10. The display panel according to claim 9, wherein the pull-down holding circuit comprises an eighth controllable switch, a ninth controllable switch . . . and a nineteenth controllable switch; a first control end of the eighth controllable switch coupled to a first end of the eighth controllable switch and a first end of the ninth controllable switch receives the first low frequency clock signal; a control end of the ninth controllable switch and a first end of the tenth controllable switch are coupled to a second end of the eighth controllable switch; a first end of the eleventh controllable switch, a control end of the twelfth controllable switch and a control end of the thirteenth controllable switch are coupled to a second end of the ninth controllable switch; a control end of the eleventh controllable switch and the pull-up control signal node are coupled to a control end of the tenth controllable switch; a first end of the fifteenth controllable switch and the pull-up circuit are coupled to a first end of the twelfth controllable switch; a second end of the first controllable switch and the pull-up control signal node are coupled to a first end of the thirteenth controllable switch; a control end of the fifteenth controllable switch, a second end of the sixteenth controllable switch and a first end of the eighteenth controllable switch are coupled to a control end of the fourteenth controllable switch; a first end of the fourteenth controllable switch is coupled to the pull-up control signal node; a second end of the seventeenth controllable switch and a first end of the nineteenth controllable switch are coupled to a control end of the sixteenth controllable switch; a first end of the sixteenth controllable switch coupled to a first end of the seventeenth controllable switch and a control end of the seventeenth controllable switch receives the second low frequency clock signal; a control end of the nineteenth controllable switch and the pull-up control signal node are coupled to a control end of the eighteenth controllable switch; a second end of the tenth controllable switch, a second end of the eleventh controllable switch, a second end of the thirteenth controllable switch, a second end of the fourteenth controllable switch, a second end of the eighteenth controllable switch and a second end of the nineteenth controllable switch are coupled to the second voltage terminal; a second end of the twelfth controllable switch and a second of the fifteenth controllable switch are coupled to the second voltage terminal.

11. The display panel according to claim 10, wherein the pull-down circuit comprises a twentieth controllable switch and a twenty-first controllable switch; a control end of the twentieth controllable switch coupled to a control end of the twenty-first controllable switch receives the scan driving signal of the next two stages; the pull-up control signal node and the pull-up circuit are coupled to a first end of the twentieth controllable switch; a second end of the twentieth controllable switch is coupled to the first voltage terminal; a first end of the twenty-first controllable switch is coupled to the pull-up circuit; a second end of the twenty-first controllable switch is coupled to the second voltage terminal.

12. The display panel according to claim 11, wherein the pull-up circuit comprises a twenty-second controllable switch, a twenty-third controllable switch and a capacitor; a control end of the twenty-third controllable switch and a first end of the twelfth controllable switch are coupled to a control end of the twenty-second controllable switch; a first end of the twenty-second controllable switch coupled to a first end of the twenty-third controllable switch receives the first clock signal; a second end of the twenty-second controllable switch outputs the stage transmission signal of the current stage; a scan line and the first end of the twenty-first controllable switch and the first end of the fifteenth controllable switch are coupled to a second end of the twenty-third controllable switch; the scan line is configured to output the scan driving signal of the current stage; a first end of the capacitor is coupled to the control end of the twenty-second controllable switch; a second end of the capacitor is coupled to the scan line.

13. The display panel according to claim 10, wherein the phase of the first clock signal is opposite to the phase of the second clock signal, and the phase of the first low frequency signal is opposite to the phase of the second low frequency signal; the periods of the first low frequency signal and the second low frequency signal are greater than the periods of the first clock signal and the second clock signal; the voltages of the first voltage terminal and the second voltage terminal are the negative voltage, and the voltage of the first voltage terminal is less than the second voltage terminal; the stage transmission signal of the previous stage is the stage transmission signal of the previous two stages, and the scan driving signal of the next stage is the scan driving signal of the next two stages.

14. The display panel according to claim 12, wherein the first controllable switch, the second controllable switch . . . the twenty-third controllable switch, the first reset switch and the second reset switch are the N-type thin film transistors; the control ends, the first ends and the second ends of the first controllable switch, the second controllable switch . . . the twenty-third controllable switch, the first reset switch and the second reset switch are respectively corresponded to the gates, the drains, and the sources of the thin film transistors.

* * * * *